US005509244A

United States Patent [19]

Bentzon

[11] Patent Number: 5,509,244

[45] Date of Patent: Apr. 23, 1996

[54] FLOORING SYSTEM HAVING JOINABLE TILE ELEMENTS, PARTICULARLY PLASTIC TILES

[76] Inventor: Frank Bentzon, C.A. Thyregodsvej 105, DK-8230 åbyhøj, Denmark

[21] Appl. No.: 146,168

[22] PCT Filed: May 13, 1992

[86] PCT No.: PCT/DK92/00153

§ 371 Date: Nov. 15, 1993

§ 102(e) Date: Nov. 15, 1993

[87] PCT Pub. No.: WO92/20885

PCT Pub. Date: Nov. 26, 1992

[30] Foreign Application Priority Data

May 13, 1991 [DK] Denmark ..... 0892/91

[51] Int. Cl.[6] ..... E04F 15/10; E04F 15/22

[52] U.S. Cl. ..... 52/387; 52/177; 52/586.1

[58] Field of Search ..... 52/177, 180, 181, 52/263, 311.1, 316, 391, 392, 582.1, 582.2, 586.1, 589.1; 446/111, 122

[56] References Cited

U.S. PATENT DOCUMENTS

| | | | |
|---|---|---|---|
| 841,998 | 1/1907 | Mulford . | |
| 1,028,058 | 5/1912 | Nordenkampf . | |
| 3,500,606 | 3/1970 | Wharmby . | |
| 4,807,412 | 2/1989 | Frederiksen | 52/177 |

FOREIGN PATENT DOCUMENTS

| | | | |
|---|---|---|---|
| 117707 | 2/1984 | European Pat. Off. . | |
| 379717 | 12/1989 | European Pat. Off. . | |
| 209979 | 11/1906 | Germany . | |
| 2812008 | 3/1978 | Germany . | |
| 1175515 | 8/1985 | U.S.S.R. | 446/122 |

*Primary Examiner*—Carl D. Friedman
*Assistant Examiner*—Yvonne Horton-Richardson
*Attorney, Agent, or Firm*—Antonelli, Terry, Stout & Kraus

[57] ABSTRACT

A floor covering system comprising plastic tiles provided with coupling parts made of lower receiving openings for separate connector members by which the tiles are easily joinable and separable and are resistant to high separation forces. The system may include smaller modular tiles so that it is possible to lay out a flooring with integrated markings of lines, letters, figures or symbols.

11 Claims, 3 Drawing Sheets

FLOORING SYSTEM HAVING JOINABLE TILE ELEMENTS, PARTICULARLY PLASTIC TILES

FIELD OF THE INVENTION

The present invention relates to a system of plastic flooring tiles and of the type, in which single tiles are designed as slightly resilient user friendly flooring members to be laid out on hard floors, with the tiles being adapted to be joined edged to edge by interengaging coupling members.

BACKGROUND OF THE INVENTION

A flooring system of the aforementioned type is disclosed in, for example, DK-C-155,616, in which it is possible to achieve a very effective coupling of the tiles by special projecting coupling parts which can be brought into engagement with complementary coupling means located retracted from the single side edges of the tiles.

While it is no doubt possible to obtain a rigid coupling between the proposed conventional tiles, though in a rather difficult manner conditioned by a pronounced resilient flexibility of the tiles and/or rather high efforts for establishing the locking engagement, it has been found as a considerable drawback that the coupling parts may be broken when the tiles are subjected to external forces and, consequently, the relevant tiles will have to be replaced as they will be without any holding connection with neighboring or adjoining tiles.

This is mainly explainable by the fact that climate conditioned heating and air conditioning of the floor will produce different degrees of associated expansion and contraction of the layers constituted by the rigid support surface and the plastic tile layer thereon, respectively, whereby, for example, a relative contraction of the tile layer will imply large pulling forces in the coupling parts integrally associated with the tiles. The coupling parts may be constructed correspondingly heavily but then without overcoming the associated productional problems relating to a desired minimization of the material consumption of the coupling parts.

SUMMARY OF THE INVENTION

With the present invention the viewpoint is adopted that it is uneconomical to secure the tiles, generally, by making their coupling parts extremely heavy and resistant, as it will then be better to use non-integrated coupling parts, which, when breakage might occur, are easily replaceable, while it is also endavoured to make it easier to effect the coupling of the tiles.

According to the invention use is made of tiles, the side edges of which are provided exclusively with receiver portions for separate coupling members, whereby these coupling members may consist of relatively small units for interconnecting the tiles. In cases where these units are broken it will be sufficient to mount new coupling members, without any changing out of the tiles themselves, whereby, for obvious reasons, a required repair will be much less expensive to carry out.

It has already been proposed to use separate coupling members between the tiles, but only in a manner such that the tiles would be difficult to join, and for the invention it is a further objective to provide a solution, whereby the coupling is easy to effect, inter alia in a manner such that the tiles may be premounted with coupling members on one pair of sides, such that these coupling members are readily engageable with the complementary sides of other tiles. By such a premounting the tiles will appear as full-cast units and yet be easy to mount, while the advantage is maintained that the coupling members will still be separately replaceable in case they should be broken by the displacement forces.

Against this background the invention provides for coupling members comprising a cross connector part having widened head portions of both ends thereof, while the tiles, along their side walls, are shaped with slots extending upwardly from the underside of the tile adapted to receive the cross connector part, while behind these slots, the tiles are provided with vertical channel portions for receiving the head portions in such a guided manner that an inserted coupling member that is upwardly into the channel portion will be held therein by a light clamping or snap lock action and will thus be stabilized in a position, in which the coupling member from the tile edge by half the length of the cross connector part, such that the projecting portion of the coupling member is ready to be connected with another tile by a relative movement, whereby the projecting part of the coupling member is introduced upwardly into the slot and channel portion of the other tile with the tiles located and thereafter locked in an edge-to-edge-position.

Hereby, for the laying of the tiles, it can be chosen to let the already laid-out tiles appear with the projecting coupling members at their free edges, whereafter further tiles can be added by a simple laying down, as by such a laying down edge to edge the complementary tile sides will enter into a locking engagement with the projecting portions of the coupling members. Inversely, the tiles may easily be separated at any desired place by a simple lifting of one tile edge from the neighboring tile edge.

Neither the edge slots nor the channel portions will need to extend up to top side plane of the single tiles, i.e. the tile top sides may extend all the way out to the edges of the tiles without being broken by these details.

For the invention it is a further aspect that a set of tiles may comprise not only the regular main tiles, e.g. with a size of 25×25, but also a selection of smaller tiles having a side length of a suitable modular fraction, e.g. 5 cm, of the side length of the main tiles and provided with coupling parts that will make these small tiles suitable for being mutually coupled together and and with the main tiles by the coupling members.

With the use of such further, smaller tiles in the flooring system several important advantages will be achievable. Thus, it will be possible to establish a floor covering along walls which are not perpendicular to each other or, by way of example, along arched pool edges, whereby it is possible to use smaller tiles having the same general appearance as the main tiles.

Alternatively, however, it may be chosen to make use of small tiles that will appear entirely different from the main tiles, e.g. by having a pronounced deviating color, whereby in the main tile flooring it will be possible to 'draw' areas or lines of a fundamentally permanent character, e.g. in connection with floorings in sport courts. Such lines may particularly easily be rectilinear, but they can also be arched, and it will thus be possible to arrange the entire flooring with signs and symbols, e.g. for indicating floor numbers and escape route arrows on off-shore units or ships, where a corresponding floor painting will not be particularly durable. Likewise the flooring may be laid out with logo pictures, e.g. on large exhibition areas. The relevant markings will be so to speak indestructable, but if desired they can be easily removed or changed without any need of breaking up larger parts of the flooring.

According to the invention, a corresponding marking possibility may be achieved in another or an additional manner, namely when the tiles are of the type provided with holes in their upper stepping layer, e.g. with a center distance of of 2–5 cm a holding pin portion a button shaped cover member may be inserted in the holes, and these cover members may then be mounted in any desired pattern on the flooring, just as they can be mounted and removal without any interference with the flooring itself. With a center distance of 2.5 cm there will be one hundred holes in tiles measuring 25×25 cm, and thus it will be possible to work with a rather high degree of dissolution in the pattern. The bottons may be produced in many different colors, but the same will apply to the small tiles.

BRIEF DESCRIPTION OF THE DRAWINGS

In the following the invention is described in more detail with reference to the drawing, wherein.

DETAILED DESCRIPTION

Figure 1:
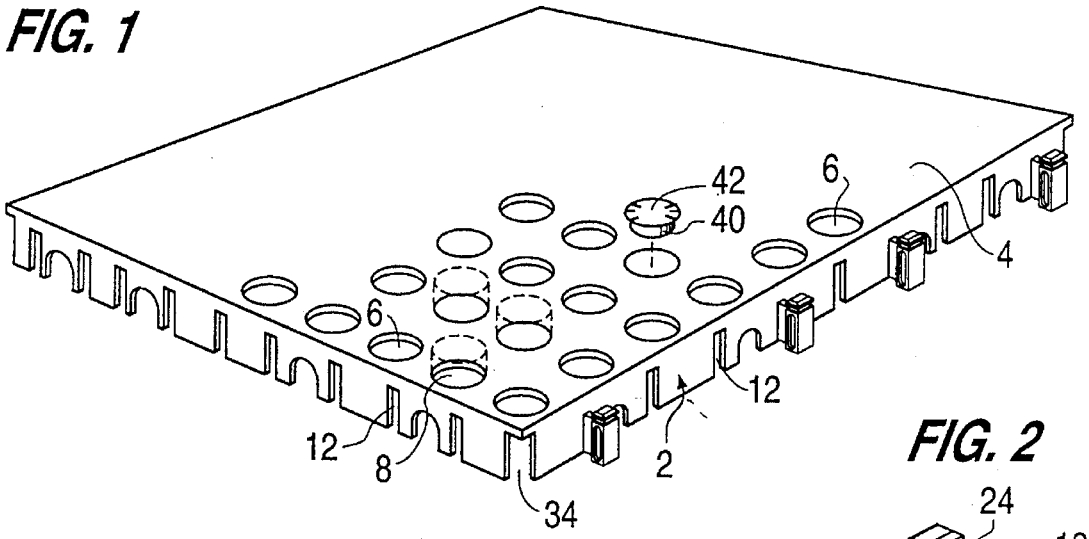
FIG. 1 is a perspective view of a tile according to the invention.
Figure 3:
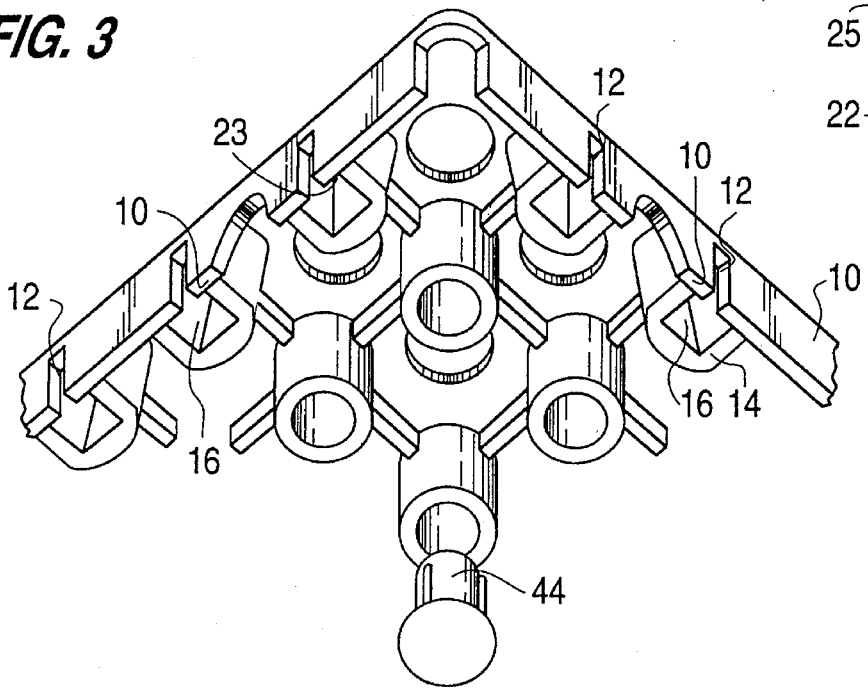
FIG. 3 is a perspective fractional view of a tile seen from below.

The tile 2 shown in FIGS. 1 and 3 is diecast and has a top layer 4, in which, as well known, there is provided holes 6, with the areas between these holes 6 having depending floor supported cylindrical carrier portions 8, and with the tile having correspondingly depending edge walls 10, In these walls a number of slots 12 and provided in a uniform manner along each of the edges, walls 10, with these slots 12 being downwardly open and extending only over a lower part of the height of the edge wall 10.

Behind each of the slots 12 there is arranged, confined by rib portions 14 depending from the top side 4, a downwardly open channel 16 which is somewhat broader than the slot 12 and extends upwardly beyond the upper end of the slot 12.

Figure 2:
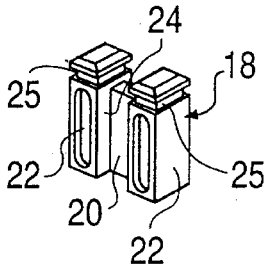
FIG. 2 is a perspective view of an associated coupling member.

To the tiles belong coupling members 18 as shown in FIG. 2, with the coupling members 18 being adapted to be brought into engagement with the inner side of the edge wall 10 behind the slot 12 in a manner such that the coupling member can hold together two adjoining tiles 2. The coupling members 18 have a middle beam portion 20, the length of which is approximately twice the thickness of the edge wall adjacent the slots 12, and opposed, wider head portions 22, which are both broader and upwardly higher than the beam portion 20. These head portions 22 are provided with interfacing parallel inner sides 24, while at their upper ends they are preferably shaped in a slightly tapered manner.

Figure 4:
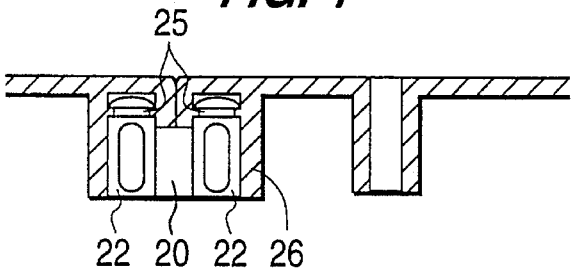
FIG. 4 is a sectional view of the joining area between two tiles.
Figure 5:
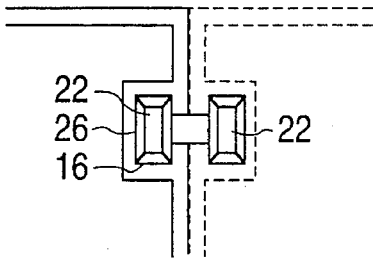
FIG. 5 is a sectional view, seen from above, of the joint between two tiles.

As clearly apparent from FIG. 5 the head portions 22 are dimensioned relative to the channels 16 such that, when they are introduced from below into the channels 16, they will be held in the channels 16 by clamping action, first of all in being clamped against a channel wall 26 located behind the rear of the slot 12. This implies that a coupling member 18 mounted in only a single tile will be held in a position, in which it will project, in a well defined manner, just so far as to be suited for engaging a neighboring tile, which can be mounted simply by lowering of a slot area 12 over the projecting part of the coupling member 18. Preferably use is also made of a snap locking, for which purpose the channels 16 are provided with rib portions 23, FIGS. 3 and 4, which may cooperate with holding grooves 25 in the head portions 22.

Figure 6:
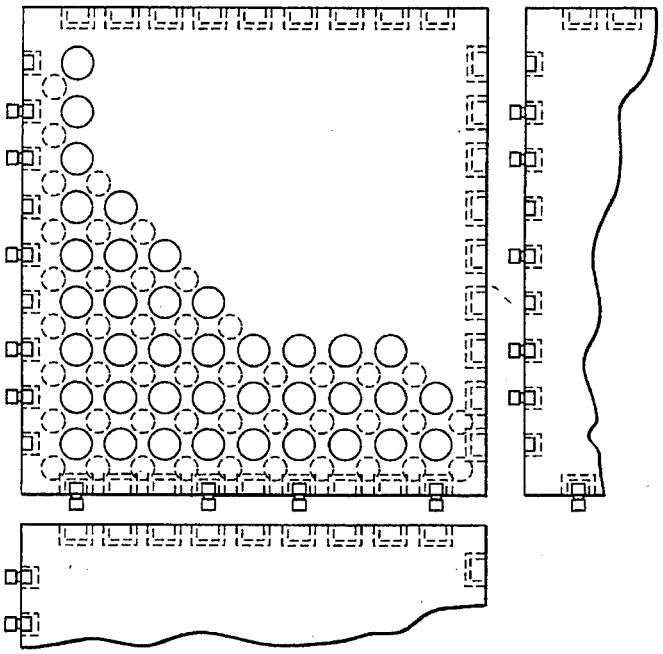
FIG. 6 is a plan view of a tile according to the invention.

This self holding engagement is conditional for the tiles being premounted with projecting coupling members 18, see FIG. 6, such that it is easily possible to couple similar neighboring tiles to the respective tile edges, viz. by a simple lowering of the new tiles 2 over the projecting coupling members 18, whereby a coherent flooring will be easy to establish.

A further holding of the coupling part is achievable when the surface thereof is provided with groove or rib portions which may cooperate lockingly with complementary rib or groove portions inside the channels 16. This type of holding or locking means is advantageously arranged near the upper ends of the freely upstanding end portions of the head portions 22, as indicated by ribs 23 in FIG. 3 and grooves 25 in FIG. 2. For the same reason it will be suitable that both the head portions 22 and the channels 16 are designed so as to engage each other all over their cross section, whether this being rectangular or rounded.

It will be appreciated that the coupling members 18 with their broad head portions 22 will provide a connection which is considerably stronger than if the beam portion 20 was just a projecting integral part of the tile edge.

There can be used any desired number of joining places along each tile edge, even different numbers in the respective two main directions as suggested in FIG. 6. Thus, this may apply e.g. to foot path floorings, where the tiles may be subjected to forces that are higher in the longitudinal direction than in the transverse direction.

It will apply generally that an occurring break of the joint between two tile edges may be repaired solely by a removing of the broken coupling members 18, this being a lot less expensive than a replacing of the relevant tiles themselves.

Thus, in connection with the invention the tiles will be both easier to lay out and much less expensive to repair, should breaks occur, as also the tiles will be more resistant against breakage in the joining areas.

These areas may be arranged in such a manner, e.g. symmetrically about the middle of each tile edge, such that the tiles 2 may be coupled together alternatively directly edge to edge or with a desired bond between only partly overlapping tile sides.

The coupling members 18 may be dimensioned otherwise as shown, e.g. with an increased width relative to their height, and the tiles 2 may be designed with reinforced edge portions at the relevant areas of engagement. According to the invention, however, it is important to adapt the dimensionings in a manner such that, in case of strong breaking forces, a possible break will occur in the coupling members and not in the associated parts of the tiles 2. The coupling members 18 could well be designed so heavily, e.g. with a large width of the beam portion 20 and a small extra width of the head portion 22.

Figure 7:
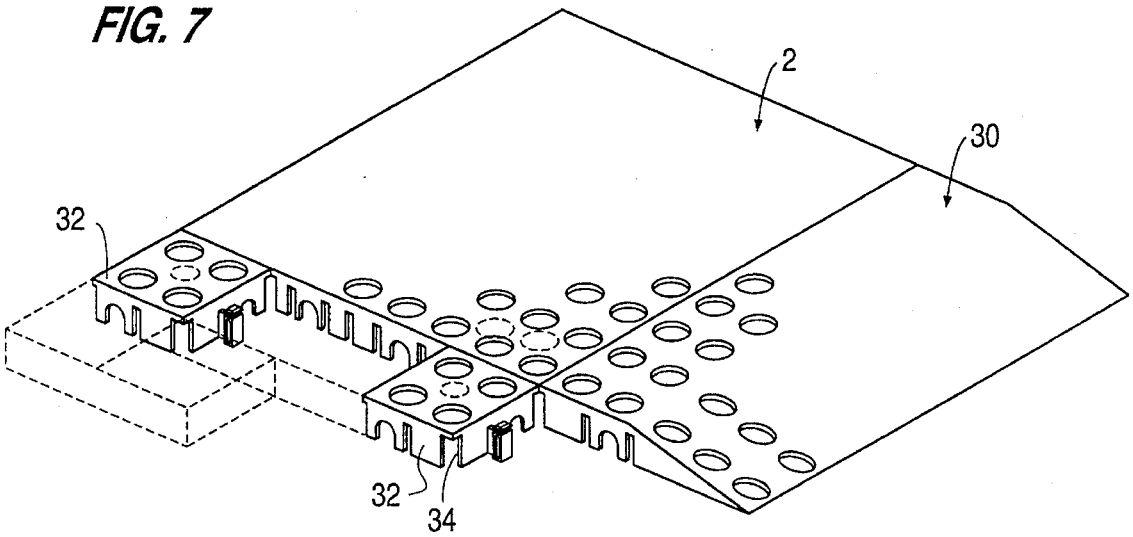
FIG. 7 is a perspective view of a tile according to the invention, coupled together partly with a ramp element and partly with modular tiles of smaller sizes.

As shown in FIG. 7, a tile 2 can be coupled to a ramp element 30 and it may further be coupled to a plurality of 'small tiles' 32 taking up a certain modular part of a side length of the tile 2. Each of these small tiles may be provided with just the same holding means for the coupling members 18 as the tile 2 itself such that they may be connected both mutually and with adjoining tiles 2.

These small tiles 32 will be immediately suited for being laid as straightlined 'lines' in a flooring having normal tiles 2 placed at both sides of such a line, e.g. if the small tiles are made with a clearly deviating surface or color.

The achievable marking effect, however, is not limited to such straight lines, as the small tiles 32 or many of them may appear with the same surface and color character as the tiles 2, while in the flooring it will be possible, then, to use single and deviating small tiles, which may be placed in any desired pattern among the other small tiles, i.e. also with a broken or arched configuration amog these other tiles.

Figure 8:
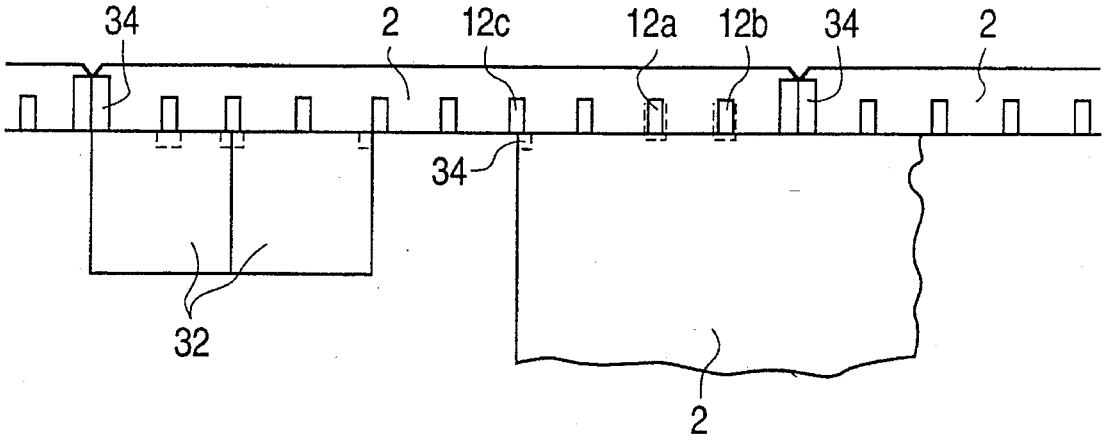
FIG. 8 is a plan view of a tile edge with marked associations of tiles of different sizes.

At the top of FIG. 8 there is shown some tiles 2 seen against an edge thereof, and underneath there is indicated a 'large tile' 2' and two 'small tiles' 32 coupled to that edge. The tile 2' is placed in bond with the upper tiles 2, e.g. with coupling members 18 mounted at the slots 12*a* and 12*b*. Should a coupling member 18 be mounted next to a corner of the tile 2', as in slot 12*c*, this particular coupling member 18 should be removed. In connection with the invention, however, it has been considered that it may perhaps be found inconvenient to have to remove such surplus coupling members, inter alia because they might be desired at the same place later on and, for that reason, the tiles, see also FIGS. 1 and 7, may be shaped with corner recesses 34 underneath the upper stepping side, such that coupling members 18 happening to be located adjacent a tile corner may be received in the adjoining corner recesses, though without any holding effect on these tiles.

Figure 9:
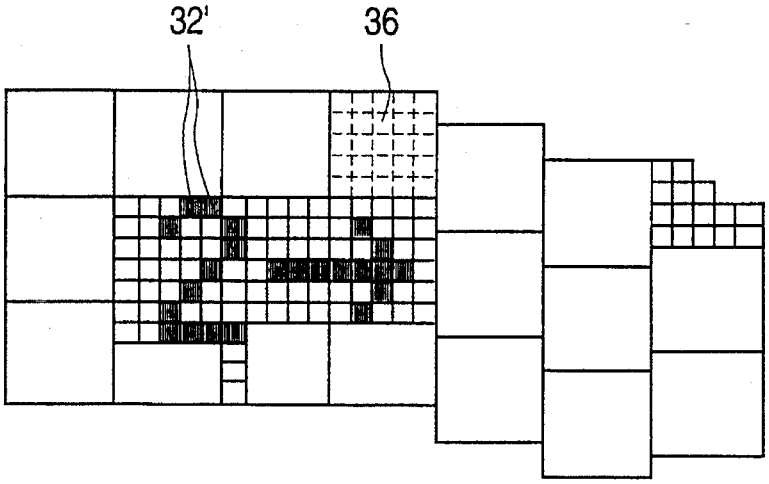
FIG. 9 is a top view of a flooring with both 'normal tiles' and 'small tiles'.

FIG. 9 shows an example of the use of the possibility of a 'written' marking by small tiles 32', the color of which deviates from the color used generally in the flooring, i.e, for both the large and other small tiles. It is shown that there may be provided for a medium sized tile corresponding to a number of small tiles. As indicated at 36, the tiles, generally, may be designed with a surface pattern corresponding to the shape of the small tiles or even to a pattern appearing on the small tiles, whereby the large tile faces will not reveal themselves visually in any other manner than the face areas built from color wise corresponding small tiles.

At certain places it may be desirable to improve the non-skid abilities of the tiles, and as shown this can be done as indicated in FIG. 3 by mounting of friction buttons 44 in some of the cylindrical carrier portions 8, e.g. only a single button at each tile corner.

Figure 10:
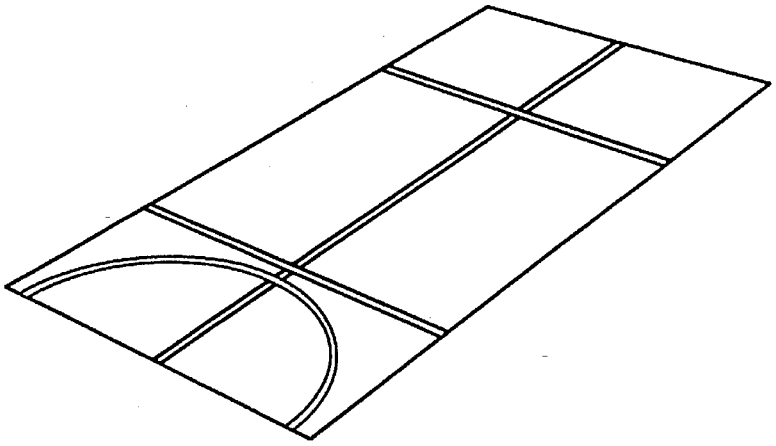
FIG. 10 is a perspective view of a flooring laid out in a sports court.

In FIG. 10 is indicated a sports court, in which there is provided marking lines with the use of small tiles 32, or of medium size tiles with the module 1×5 small tiles, or by using the marking buttons 40,42.

I claim:

1. A floor covering system including a plurality of tiles coupled together to form a floor covering, wherein each of the tiles includes edge areas extending completely around the respective tiles and including a plurality of downwardly open channels disposed behind vertically extending edge walls of the tiles, a plurality of coupling members with each coupling member having a pair of head portions respectively inserted into one of the plurality of channels of adjacent tiles, a middle portion projecting outwardly through an upwardly closed and downwardly open vertical slot in each of the edge walls of the adjacent tiles, a width in a horizontal direction of the middle portion less than a height of the middle portion and less than a width of each of the pair of head portions in a horizontal direction, the open slot having a height greater than a width thereof, and the height of the middle portion extending vertically in the open slot.

2. A system according to claim 1, wherein each of the head portions of the coupling members and said channels are provided with means for enabling a releasable retention of the respective coupling members.

3. A system according to claim 2, wherein said means for enabling a releasable retention includes complementary ribs and grooves provided on said head portions and said channel means.

4. A system according to claim 2, wherein the coupling members are premounted along two adjacent sides of the respective tiles.

5. A system according to claim 1, wherein interfacing sides of two opposed head portions on the respective coupling members are arranged in parallel with one another for cooperation with correspondingly planar rearwardly facing edge wall portion at both sides of each of the downwardly open slots.

6. A system according to claim 1, wherein the head portions of the coupling members are higher than the middle portion, and wherein the slots are only as high as the middle portion.

7. A system according to claim 1, wherein coupling areas at the vertical slots are located with a modular spacing such that the respective tiles are couplable bondwise, and wherein tile corners of the respective tiles are provided with recess for a non-retention reception of coupling members which may occur on the adjoining tiles.

8. A system according to claim 1, wherein groups of the tiles have a top surface area of different sizes but the tiles of the groups are connected to each other with the coupling members.

9. A system according to claim 8, wherein a first portion of the groups of tiles which have a smaller surface area have the same color as remaining tiles with a larger surface area while a second portion of the groups with the smaller surface area has a different color.

10. A system according to claim 7, wherein a top side of the respective tiles is perforated, and the system further comprises marking buttons engaging selected perforations in a top side of the respective tiles.

11. A system according to claim 8, wherein the tiles are of different colors so as to enable a predetermined pattern to be formed in the flooring.

* * * * *